US006496160B1

(12) United States Patent
Tanner et al.

(10) Patent No.: US 6,496,160 B1
(45) Date of Patent: Dec. 17, 2002

(54) STROKE TO RASTER CONVERTER SYSTEM

(75) Inventors: Allen H. Tanner, Sandy, UT (US); Calvin L. Simmons, Bountiful, UT (US)

(73) Assignee: Evans & Sutherland Computer Corporation, Salt Lake City, UT (US)

( * ) Notice: Subject to any disclaimer, the term of this patent is extended or adjusted under 35 U.S.C. 154(b) by 0 days.

(21) Appl. No.: 09/301,947

(22) Filed: Apr. 29, 1999

(51) Int. Cl.[7] ..... G09G 5/00

(52) U.S. Cl. ..... 345/3.1; 345/3.2; 345/10; 345/14; 345/17; 345/27; 345/545; 348/399; 348/440; 348/571; 348/572

(58) Field of Search ..... 345/3.1, 3.2, 10–14, 345/16, 17, 20, 27–29, 539, 545, 530; 348/382, 399, 413, 414, 428, 440, 571, 572, 805, 806

(56) References Cited

U.S. PATENT DOCUMENTS 4,633,243 A * 12/1986 Bresenham et al. ..... 345/17
5,489,920 A * 2/1996 Kaasila ..... 345/136
5,557,297 A * 9/1996 Sharp et al. ..... 345/136
5,969,699 A * 10/1999 Balram et al. ..... 345/10

* cited by examiner

*Primary Examiner*—Richard Hjerpe
*Assistant Examiner*—Henry N. Tran
(74) *Attorney, Agent, or Firm*—Thorpe North & Western, LLP

(57) ABSTRACT

An apparatus for converting analog stroke display signals representing electron beam generated stroke traces into raster display information for producing a raster-scan image display. The apparatus includes a sampling circuit for sampling the analog stroke display signals to produce pixel data representing sub-pixel locations covered by the stroke traces. A frame buffer is coupled to the sampling circuit to temporarily store pixel data. A filter is coupled to the frame buffer for calculating brightness of pixels based upon the amount of coverage of the pixels by a stroke trace. In addition, a raster-scan display device is coupled to the filter for receiving the pixel data from the filter to produce a raster-scan image.

10 Claims, 2 Drawing Sheets

Stroke/Raster Converter Block Diagram

STROKE TO RASTER CONVERTER SYSTEM

BACKGROUND OF THE INVENTION

This invention relates to apparatus and method for converting analog stroke display signals to raster display information for developing a raster-scan image display.

Computer graphics involves the development of images for display on some type of display device. The display devices developed and used initially in computer graphics were known as a vector, stroke or line drawing displays. (The terms "vector" and "stroke" are synonymous with "line".) To develop characters for display, the character outlines were composed of sequences of strokes, produced by moving an electron beam of a cathode ray tube (CRT) to draw the character on the phosphor coating of the CRT screen. The electron beam is deflected, to draw the character, by beam-deflection circuits in response to analog voltages developed by a vector or stroke generator.

The stroke generator of a stroke display device typically develops an analog X major deflection signal and an analog Y major deflection signal for moving the electron beam from one general location to another. Some stroke generators also developed an additional analog x character deflection signal and an additional analog y character deflection signal for guiding the electron beam within the general location to which the beam has been moved, to draw or trace a line, character, symbol, etc.

The final signal typically developed by a stroke generator is a three voltage level video signal, having a 0 volt level to indicate that the electron beam is off (a condition where the beam is to be moved from one location to another without producing a trace), a 1 volt level defining a certain brightness of the trace when moving the beam from one general location to another to produce a trace, but not to draw a character, and a 2 volt level for increasing the brightness of the trace when drawing a character after the beam has been moved to a desired character location. The brightness is increased when drawing a character since the movement of the beam is much faster than when simply moving the beam from one location to another; the voltage level must be boosted just to maintain the brightness of the drawn character to about the same as the brightness of the trace.

The next major development in computer graphics was that of raster graphics or raster display devices, which were based on television technology. Raster displays store so-called display primitives (such as lines, characters, and solidly shaded or patterned areas) in a refresh buffer, in the form of component pixels. The image on a raster display device is formed from a set of horizontal raster lines, each line containing a row of individual pixels. The "raster" is stored in a frame buffer as a matrix of pixels representing the entire screen (frame) area. The image is scanned out sequentially by a video controller, one raster line at a time, from top to bottom and then back to the top, in the same manner as a television picture or image is created. Each pixel includes information to determine the electron beams intensity when being moved through that pixel location on the screen. All this is well known technology and a full description and discussion is given in Foley, James D. et al., *Computer Graphics Principles and Practice*, Addison-Wesley Publishing Company, 1996.

Raster displays have a number of advantages over stroke displays including the need for less expensive image generating logic. Also, raster displays can fill areas with a uniform color or a repeated pattern in two or more colors, and can store images in a way that allows manipulation at a fine level, including the copying or moving of selected portions of an image.

One disadvantage of a raster display, compared to a stroke display, results from the discrete nature of the pixel representation. Primitives are specified in terms of their end points (vertices) and must be scan-converted into their component pixels in the frame buffer. Because each primitive must be scan-converted, real-time processing is computationally more complicated for raster displays than for stroke displays. Nevertheless, most computer graphics systems today utilize raster displays.

Because large numbers of stroke display systems had been installed in the past and many are still in use today (for example, stroke display systems are common in commercial and military aircraft), it has been found desirable, when upgrading an existing stroke display system, to save as much of the existing circuitry as possible, especially the stroke generator circuitry. As a result, stroke to raster converters have been developed to enable use of the stroke generator, but to convert the stroke generation signals to raster producing signals for use on a raster display device. In effect, a raster display replaces the stroke display to develop the desired images.

The prior art approach to converting from stroke to raster displays involved sampling the analog stroke signals to obtain data indicating the brightness of the stroke trace, and then adding the samples for corresponding similar pixel locations to obtain a composite pixel representation of the stroke trace. A problem with this approach is that for crossing or intersecting traces, the trace would be sampled twice where the trace is crossed or intersected, and the pixel representation of such crossing or intersection would be an excessively bright spot. Of course, if a number of characters are displayed on the screen, each with a number of line intersections, then the image would be quite disconcerting when viewed because of the number of excessively bright spots.

SUMMARY OF THE INVENTION

It is an object of the invention to provide apparatus for converting a stroke video signal in real-time to appropriate pixel and sub-pixel data for generating raster video display.

It is another object of the invention to provide a stroke to raster converter which provides high resolution in the resulting raster display.

It is also an object of the invention to provide such a converter which is easy and relatively inexpensive to implement.

It is a further object of the invention to provide such a converter, in accordance with one aspect thereof, for performing anti-aliasing during the conversion process.

It still another object of the invention, in accordance with another aspect thereof, to provide such a converter in which "weighting" of sub-pixels is employed to present improved definition of lines and objects presented for display.

The above and other objects are realized in an illustrative embodiment of apparatus for converting stroke display signals (representing electron beam generated stroke traces) into raster display information for developing a raster video image display. The apparatus includes a sampling circuit for sampling the analog stroke display signals to produce pixel data representing pixel locations covered or touched by the stroke traces, a frame buffer for temporarily storing the pixel data samples for subsequent supply to a raster display device.

In accordance with one aspect of the invention, the sampling circuit is adapted to sample at a rate sufficient to allow development of digital representations of pixels subdivided into arrays of sub-pixels with indications of which sub-pixel locations were covered or drawn by the stroke trace.

In accordance with another aspect of the invention, a filter, is provided between the frame buffer and the display device for calculating brightness of pixels based upon the amount of A coverage of the pixel by the stroke trace.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
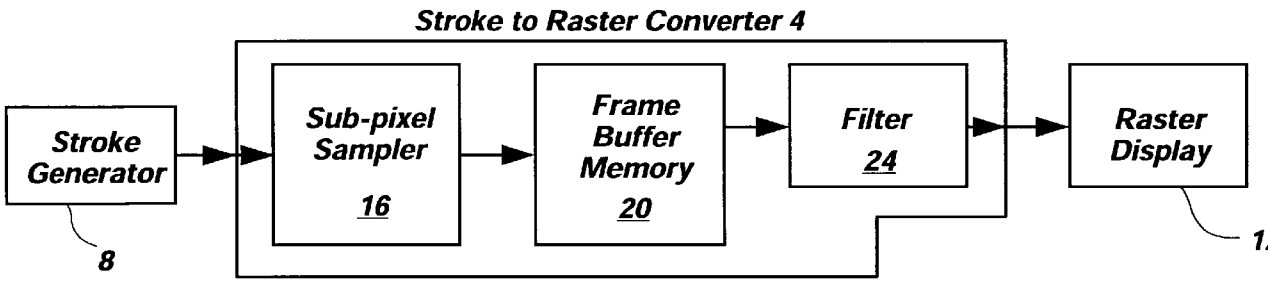
FIG. 1 is a block diagram representation of a stroke to raster converter made in accordance with the principles of the present invention.

Referring to FIG. 1, there is shown one illustrative embodiment of a stroke to raster converter 4 for receiving analog stroke signals from a stroke generator 8 and for converting those signals to pixel data for producing a raster image for display on a raster display device 12.

The stroke-generator 8 develops five analog signals, as discussed previously, including an X major deflection signal, a Y major deflection signal, (defining respectively the X axis and Y axis end point coordinates of a stroke trace), an x character deflection signal, a y character deflection signal (defining respectively the x axis and y axis coordinates of a character stroke trace as a character is being drawn), and a three-level video signal in which a voltage level of 0 indicates that the electron beam is to be moved but the beam is off, a voltage level of 1 indicates that a stroke trace or line is to be drawn by the electron beam at a first brightness level, and a voltage level of 2 indicates that a character is to be drawn by the electron beam at the general location to which the electron beam has been moved, with the character trace to be at a second higher brightness level. In other words, a 0 voltage level means move the electron beam but don't produce a trace, a 1 voltage level means draw strokes and conics, and a 2 voltage level means draw characters.

The X and Y major deflection signals and x and y character deflection signals are sampled by a sub-pixel sampler 16 at rates and resolutions that correspond to four samples per pixel in each of the x and y axes. For example, for the X and Y major deflection signals, a sampling at 22.5 Mhz to twelve bits of resolution could be utilized, and for the x and y character deflection signals, the sampling could be carried out at 45 Mhz to eight bits of resolution.

The above exemplary sampling results in a four-by-four array of sixteen sub-pixels or bits for each pixel location (to be displayed on the raster display device 12 where a sub-pixel shows a "1" if the sub-pixel was covered or touched by the stroke trace being sampled and a "0" if the sub-pixel was not covered or touched by the stroke trace.

The pixels, composed of sixteen sub-pixels, are supplied to a frame buffer memory 20 for temporary storage and for ultimate supply to a filter 24 and then to the raster display device 12 to enable producing the raster images. The sub-pixels in the frame buffer memory 20 are set at "1" if those sub-pixels are covered by only one stroke trace or many stroke traces (i.e., if a sub-pixel is drawn one or many times), and set at "0" if the sub-pixels are not covered (i.e., the sub-pixel locations are not drawn). The result is that no pixel locations on the raster display will have a disconcerting increase in brightness simply because that pixel represents an intersection or crossing of stroke traces, as with prior art stroke to raster converter systems.

The filter 24 calculates the intensity of a given pixel from the sub-pixel samples of the given pixel and from adjacent pixels. This results in smoother appearing lines and edges of objects to be displayed on the raster display unit 12.

Figure 2:
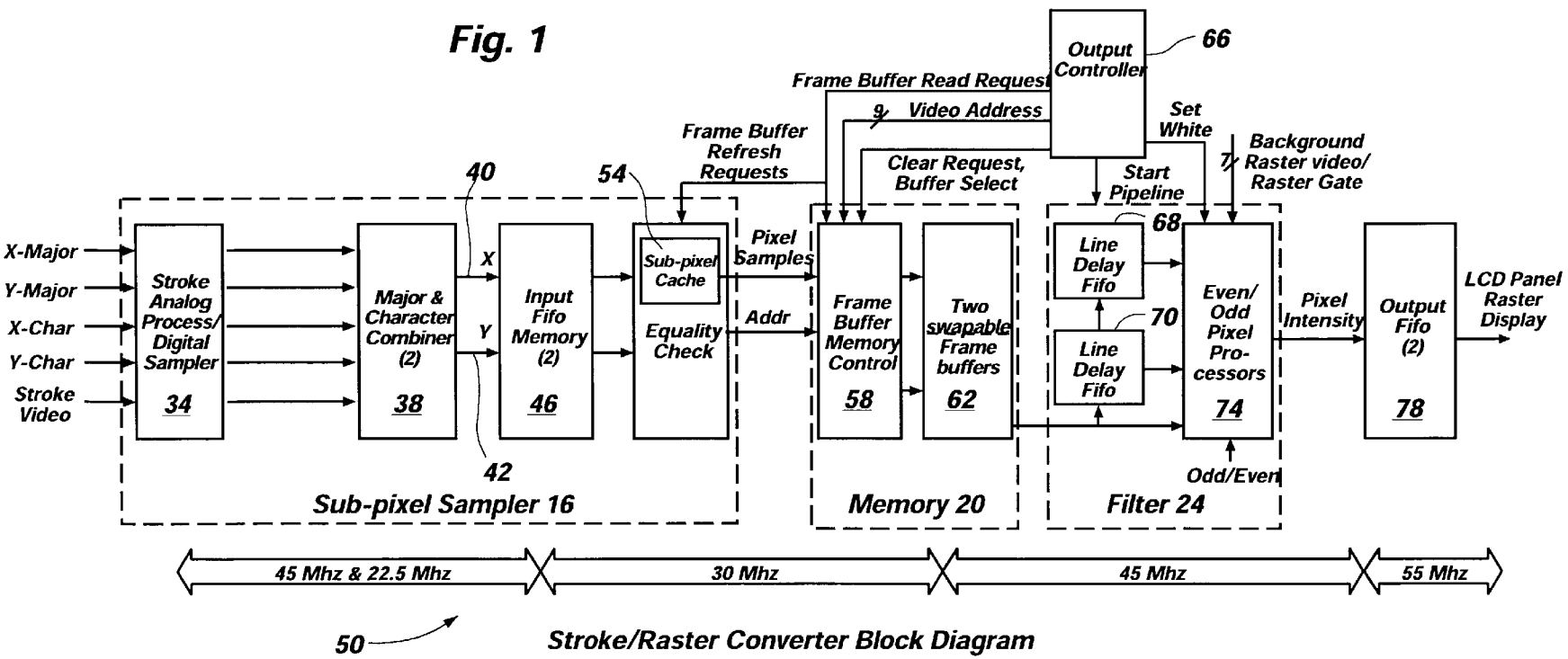
FIG. 2 is a schematic representation of one illustrative embodiment and implementation of the converter of FIG. 1.

FIG. 2 illustrates representative components of the sub-pixel sampler 16, frame buffer memory 20, and filter 24 and will now be discussed. A stroke analog process/digital sampler 34 samples the X major and Y major deflection signals and the x and y character deflection signals as previously described, and effectively operates as an analog-to-digital converter to produce digitized samples. The digitized samples are supplied to a major and character combiner 38, along with the previously described three-level video signal (labeled "stroke video" in FIG. 2). When the stroke video signal is at level 2, indicating that the sampled stroke trace is drawing a character, the combiner 38 adds the digitized samples of the X major and x character deflection signals, and adds the digitized samples of the Y major and y character deflection signals, and supplies the sums respectively on an X output line 40 and a Y output line 42 to an input first in, first out (FIFO) memory 46. When the stroke video signal is at level 1, indicating that no character is being drawn but that the electron beam is being moved from one location to another while drawing a stroke trace, the digitized samples of the X major and Y major deflection signals are passed respectively via lines 40 and 42 to the input FIFO memory 46. Finally, when the stroke video signal is at level 0, indicating that no character or stroke trace is being drawn, i.e., the electron beam is off, then no digitized samples or signals are supplied to the input FIFO memory 46.

The data supplied to and stored in the input FIFO memory 46, for example, might consist of a twelve bit Y deflection value and a thirteen bit X deflection value (the X deflection value contains more bits to accommodate the larger number of pixels arranged horizontally across a typical display screen than are arranged vertically) representing a sub-pixel location on the screen of the raster display device 12. The input FIFO memory 46 is provided as buffer since the input processing to the FIFO memory is being carried out faster than the output processing (see the frequency graph 50 shown below in the schematic in FIG. 2 to indicate exemplary processing speeds for the different portions of the schematic).

In the next stage of processing, adjacent sub-pixel samples are combined into pixel samples as follows. The low order two bits of the X and Y deflection values define the sub-pixel location within the pixel (made up of sixteen sub-pixels arranged in four rows of four sub-pixels). The rest of the bits define the pixel location.

The sub-pixel sampler 16 (FIG. 1) includes a sub-pixel cache 54 (FIG. 2) to which the sub-pixels making up a pixel are supplied from the input FIFO memory 46 and temporarily stored. The cache 54 will only store the sub pixels of a single pixel. When the sub-pixels from another pixel arrive the contents of the cache are written into the frame buffer 20.

The sub-pixel cache 54 is then cleared and the bit associated with the next sampled sub-pixel in the new pixel location is written into the cache.

The frame buffer memory 20 includes a conventional frame buffer memory control unit 58 and two "swappable" frame buffers 62. While one of the frame buffers 62 is supplying pixel data to the filter 24 (for ultimate delivery to the raster display unit 12 to develop a raster image), the other frame buffer is being loaded with the next frame of pixel data. When that loading is complete, and the first-mentioned frame buffer is completely "unloaded", then loading of the first-mentioned frame buffer begins and unloading of the other frame buffer also begins. This is carried out under control of the frame buffer memory control unit 58 in a conventional fashion. The frame buffer 62 might advantageously be comprised of video random access memories (VRAMs).

The output portion of the stroke to raster converter of FIG. 2 is designed to create video images for display on a liquid crystal display (LCD) or CRT display in real-time from the sub-pixel data stored in the frame buffers 62. If an LCD panel is employed, an even/odd pixel pair would be supplied to the panel, for example, approximately every eighteen nanoseconds (5.5 MHz)). The rate at which pixels would be produced is reduced to one pair per 22.5 nanoseconds (45 MHz.) by utilizing the entire horizontal line time to produce the active pixels and store them in a FIFO memory 78. The pixels are supplied to the LCD panel one line later at the required 55 MHz rate under control of an output video format controller 66. Note again that the speed at which the various components of the stroke to raster converter of FIG. 2 operate is shown in the frequency graph 50 located below the schematic in FIG. 2.

The process of producing the video pixel pairs and storing them in the FIFO memory 78 is synchronized to the output video timing on a line by line basis. In particular, at a predetermined time during the output line processing, a request is generated by the output controller 66 and supplied to the frame buffer memory control 58 to read a scan line of data into one of the two frame buffers 62. The even/odd pixel pairs, each consisting of thirty-two bits of sub-pixel samples, are presented to line delay FIFOs 68 and 70 consisting, for example, of four FIFOs. Two of the FIFOs handle the odd pixels and the other two handle the even pixels, all in parallel. The output of the first pair of FIFOs is supplied to the input of the second pair of FIFOs, with the FIFO read and write "enables" being arranged so that each FIFO represents one line. The data thus available from the frame buffer 62, line delay FIFO 68 and line delay FIFO 70 represents a block of pixels three,lines high and two pixels wide, and this data is supplied simultaneously to separate even/odd pixel processors 74.

The even/odd pixel processor 74 calculates the intensity of the pixels for ultimate display on the raster display unit 12 (FIG. 1). The pixels with intensity designations are then supplied to an output FIFO memory 78, for transfer to the raster display unit 12 in accordance with the video timing required by the display unit.

In the present embodiment the intensity of a given pixel is calculated from the sub-pixel samples of a nine-pixel area composed of the given pixel and the eight adjacent pixels. The information needed to calculate the intensity of a pixel is available by looking at the data from the current six-pixel area (discussed above) and the Previously processed and saved six-pixel area. The current and previous six-pixel areas, of course, represent a twelve-pixel area of the raster display unit screen, and the even pixel intensities are calculated from a nine-pixel area which does not include the last column of the twelve-pixel area, while the odd pixel intensities are calculated from a nine-pixel area that does not include the first column of pixels of the twelve-pixel area. This processing approach is convenient for dealing with the even/odd pixel pair supplied to the even/odd pixel processor 74.

Figure 3:
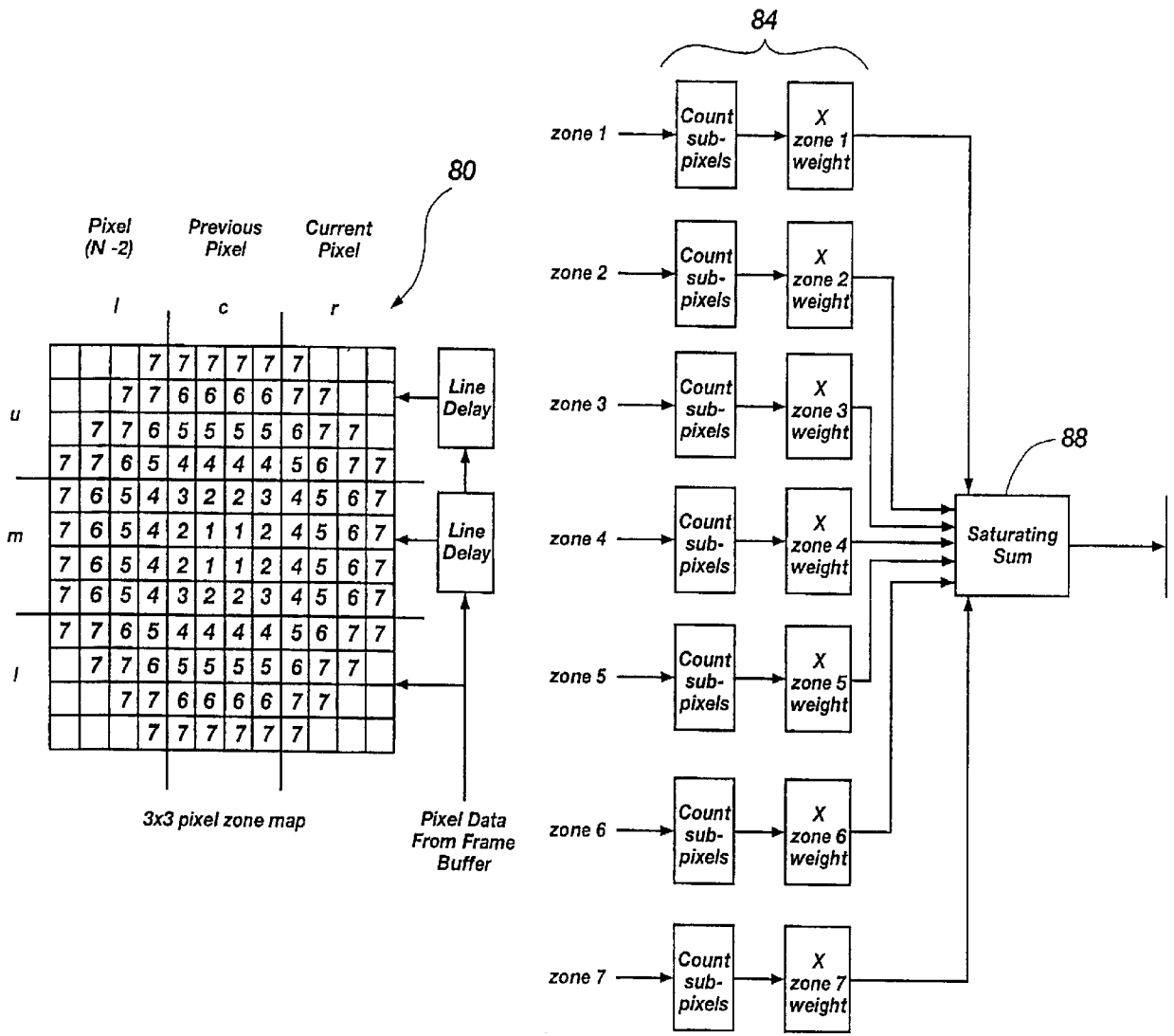
FIG. 3 is a schematic representation of one embodiment of a detailed implementation of the filter of FIG. 2.

FIG. 3 shows further details of the filter 24 and even/odd pixel processor 74 (FIG. 2) including a representative nine-pixel area 80 from which the intensity of the center pixel would be calculated. As shown, each pixel is composed of sixteen sub-pixels or bits, and the sub-pixels are grouped into seven zones based on the distance of each sub-pixel from the center of the pixel of interest. The corners of the nine-pixel grouping are not assigned to a zone and are not included in the calculation of the brightness of the center pixel so that the area used to calculate brightness is roughly circular. The contribution to brightness or intensity by the sub-pixels in each zone is a function of (1) how many of such sub-pixels were drawn or covered by a stroke trace and (2) a zone weight. The zone weights are assigned so that those close to the center of the area have the most weight while those at the edge don't contribute as much.

The intensity for the center pixel of a nine-pixel area is calculated by counting or adding the number of sub-pixels in each zone which are drawn or covered by a stroke trace and then multiplying that sum by the weight assigned to that zone using a table lookup operation. A summing tree logic configuration 84 (FIG. 3) is employed to do this. The products for each zone calculation are then supplied to an adder 88, which sums the products to produce a resulting intensity value for the pixel of interest. This output is then supplied to the raster display 12 (FIG. 1) for generation of the image.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. Apparatus for converting analog stroke display signals representing electron beam generated stroke traces, into raster display information for producing a raster-scan image display, including:

a sampling circuit for sampling the analog stroke display signals to produce pixel data representing sub-pixel locations covered by the stroke traces;

a frame buffer coupled to the sampling circuit for temporarily storing pixel data;

a filter coupled to the frame buffer for calculating brightness of pixels based upon the amount of coverage of the pixels by a stroke trace; and a raster-scan display device coupled to the filter for receiving the pixel data from the filter to produce a raster-scan image;

wherein the stroke display signals include an analog X major deflection signal and an analog Y major deflection signal defining respectively the X axis and Y axis end point coordinates of a stroke trace, and wherein said sampling circuit includes an analog-to-digital converter for producing digitized representations of the X and Y major deflection signals, representing sub-pixel locations covered by the stroke trace;

wherein the stroke display signals further include signals further include an analog x character deflection signal and an analog y character deflection signal defining respectively the x axis and y axis coordinates of a character stroke trace as a character is being drawn, and wherein the analog-to-digital converter produces digitized samples (digital representations) of x and y character deflection signals, representing sub-pixels locations covered by the character stroke trace;

wherein the stroke display signals further include a three-level video signal in which a level 0 indicates that the electron beam is to be moved while off, a level 1 indicates that a stroke trace is to be drawn by the electron beam (at a first brightness level), and a level 2 indicates that a character is to be drawn by the electron beam (at a second brightness level), said sampling circuit further including a sample combiner for adding the digitized samples of the X major and x character deflection signals and adding the digitized samples of Y major and y character deflection signals when the video signal is a level 2, and supplying the sums to the frame buffer, for supplying the digitized samples of the X major and Y major deflection signal to the frame buffer when the video signal is a level 1, and for supplying no digitized samples to the frame buffer when the video signal is a level 0.

2. Apparatus as in claim 1 wherein said sampling circuit is adapted to sample each of the X major, Y major, x character, and y character deflection signals at a rate corresponding to at least four samples per pixel in each axis of the pixel data, to thereby produce digital representations of pixels divided into at least four by four arrays of sub-pixels indicating sub-pixel locations covered by the stroke trace.

3. Apparatus as in claim 2 further including a cache memory for receiving and temporarily storing each pixel for supply to the frame buffer.

4. Apparatus as in claim 3 wherein said frame buffer includes two frame buffer memories, one for loading with pixel data while the other is supplying pixel data to the display device, and vice-versa.

5. Apparatus for converting analog stroke display signals representing electron beam generated stroke traces, into raster display information for producing a raster-scan image display, including:

a sampling circuit for sampling the analog stroke display signals to produce pixel data representing sub-pixel locations covered by the stroke traces;

a frame buffer coupled to the sampling circuit for temporarily storing pixel data;

a filter coupled to the frame buffer for calculating brightness of pixels based upon the amount of coverage of the pixels by a stroke trace; and a raster-scan display device coupled to the filter for receiving the pixel data from the filter to produce a raster-scan image;

wherein the stroke display signals include an analog X major deflection signal and an analog Y major deflection signal defining respectively the X axis and Y axis end point coordinates of a stroke trace, and wherein said sampling circuit includes an analog-to-digital converter for producing digitized representations of the X and Y major deflection signals, representing sub-pixel locations covered by the stroke trace;

wherein the stroke display signals further include a two-level signal in which a level 0 indicates that the electron beam is to be moved while off, and a level 1 indicates that a stroke trace is to be drawn by the electron beam, wherein video signal levels of the digitized samples of the X major and Y major deflection signals are supplied to the frame buffer when the video signal is a level 1, and wherein no video signal level for the digitized samples is supplied to the frame buffer when the video signal is a level 0.

6. Apparatus as in claim 5 wherein said sampling. circuit is adapted to sample the X major, and Y major, deflection signals at a rate corresponding to four samples per pixel in each axis of the pixel data, to thereby produce digital representations of pixels divided into four-by-four arrays of sub-pixels indicating sub-pixel locations covered by the stroke trace.

7. Apparatus as in claim 6 further including a cache memory for receiving and temporarily storing each pixel for supply to the frame buffer.

8. Apparatus as in claim 6 wherein said frame buffer includes two frame buffer memories, one for loading with pixel data while the other is supplying pixel data to the display device, and vice-versa.

9. A method for converting analog stroke display signals representing electron beam generated stroke traces, into raster display information for producing a raster-scan image display, including the steps of:

sampling the analog stroke display signals using a sampling circuit to produce pixel data representing sub-pixel locations covered by the stroke traces, storing pixel data received from the sampling circuit in a frame buffer, filtering pixel data received from the frame buffer to calculate brightness of pixels based upon the amount of coverage of the pixels by a stroke trace;

receiving the pixel data from the filter into a raster-scan display device to produce a raster-scan image;

producing digitized samples (digital representations) of analog X and analog Y major deflection signals of strokes display signals, representing pixel locations covered by the stroke trace, wherein the analog X major deflection signal and the analog Y major deflection signal define respectively, the X axis and Y axis end point coordinates of a stroke trace, and wherein said sampling circuit includes an analog-to-digital converter to produce the digitized samples;

producing digitized samples (digital representations) of analog x and analog y character deflection signals of stroke display signals, representing pixel locations covered by a character stroke trace wherein the x and y character deflection signals further define respectively the x axis and y axis coordinates of a character stroke trace as a character is being drawn, and wherein the sampling circuit further includes analog-to-digital converter circuitry to produce the digitized samples;

supplying a three-level video signal along with the stroke display signals in which a level 0 indicates that the electron beam is to be moved while off, a level 1 indicates that a stroke trace is to be drawn by the electron beam (at a first brightness level), and a level 2 indicates that a character is to be drawn by the electron beam (at a second brightness level);

adding the digitized samples of the X major and x character deflection signals is and adding the digitized samples of the Y major and y character deflection signals when the video signal is a level 2, using a sample combiner contained in said sampling circuit; and supplying the sums to the frame buffer, for supplying the digitized samples of the X major and Y major deflection signals to the frame buffer when the video signal is a level 1, and supplying no digitized samples to the frame buffer when the video signal is a level 0.

10. The method as in claim 9 wherein said sampling circuit is adapted to sample each of the X major, Y major, x character, and y character deflection signals at a rate corresponding to at least four samples per pixel of the pixel data on each axis, to thereby produce digital representations of pixels divided into four-by-four arrays of sub-pixels indicating sub-pixel locations covered by the stroke trace.

* * * * *